US009901169B1

(12) United States Patent
Schenker et al.

(10) Patent No.: US 9,901,169 B1
(45) Date of Patent: Feb. 27, 2018

(54) ONE PIECE COLLAPSIBLE SHELVING UNIT

(71) Applicant: Advantus, Corp., Jacksonville, FL (US)

(72) Inventors: David A. Schenker, Cedarburg, WI (US); Chris Pitzo, Pewaukee, WI (US)

(73) Assignee: Advantus, Corp., Jacksonville, FL (US)

( * ) Notice: Subject to any disclaimer, the term of this patent is extended or adjusted under 35 U.S.C. 154(b) by 0 days.

(21) Appl. No.: 15/367,384

(22) Filed: Dec. 2, 2016

(51) Int. Cl.
*A47B 43/00* (2006.01)
*A47B 47/00* (2006.01)
*A47B 96/02* (2006.01)

(52) U.S. Cl.
CPC ..... *A47B 43/00* (2013.01); *A47B 47/0058* (2013.01); *A47B 96/021* (2013.01)

(58) Field of Classification Search
CPC ... A47B 43/00; A47B 96/021; A47B 47/0058; A47B 2220/0072; A47B 21/00; A47B 87/0215; A47B 2200/0069; A47F 5/10
USPC ..... 211/149
See application file for complete search history.

(56) References Cited

U.S. PATENT DOCUMENTS 915,618 A * 3/1909 Mattison ..... A47B 43/02 108/179
1,602,410 A * 10/1926 Hamblin ..... A47F 5/108 108/179
3,840,243 A * 10/1974 Rheinhart ..... B62B 3/002 280/33.996
3,977,689 A * 8/1976 Rosa ..... B62B 3/025 211/150
4,322,005 A * 3/1982 Robertson ..... A47F 5/116 108/136
5,882,098 A * 3/1999 Brown ..... A47B 3/08 108/179
7,832,571 B2 * 11/2010 Felsenthal ..... A47B 47/027 211/134
9,144,332 B2 9/2015 Lim
9,247,809 B1 2/2016 Hsu
9,282,820 B2 3/2016 Lo
2003/0057171 A1 * 3/2003 Wang ..... A47B 43/00 211/195
2011/0031200 A1 * 2/2011 Chen ..... A47B 43/00 211/149

* cited by examiner

*Primary Examiner* — Ko H Chan
(74) *Attorney, Agent, or Firm* — Andrus Intellectual Property Law, LLP

(57) ABSTRACT

A shelving unit movable between a shelf-supporting condition and a collapsed condition includes first and second side support frames pivotally connected to a rear support frame. At least one shelf is pivotally mounted to the rear support frame for movement between a horizontal position supported on the first and second side support frames, and a vertical position removed form the first and second side support frames. The first and second side support frames are folded upon one another forwardly of the at least one shelf in the vertical position thereof and parallel to the rear support frame to form a compact folded, layered, parallel arrangement so that the shelving unit is easy to store and transport.

5 Claims, 6 Drawing Sheets

ONE PIECE COLLAPSIBLE SHELVING UNIT

FIELD

The present disclosure relates generally to article holding racks or shelving units and, more particularly, pertains to shelving units which are preassembled, collapsible and utilized to support and store a variety of goods.

BACKGROUND

Article holding racks or shelving units are commonly used by people in homes, schools and workplaces to hold various articles, such as books and magazines, plants, small appliances, knick-knacks, clothes and other personal items. Many of these units are designed to be folded or disassembled to reduce size and profile for storage. Unfortunately, many of these known units remain difficult to fold or assemble and disassemble such that storage and setup can be inconvenient. In this regard, the construction of a number of these units is rather complex, leading to increased costs of production or inconvenience to the user.

It remains desirable to provide a preassembled, one piece shelving unit which can be simply and quickly unfolded to a shelf-supporting position, and folded to a collapsed position to enable ease of storage and transport.

SUMMARY

In one example, the present disclosure relates to a shelving unit which is movable between a shelf-supporting condition and a collapsed condition. The shelving unit includes a rear support frame having a pair of vertical side members, and a set of horizontal members extending between the vertical side members. A first side support frame is pivotally mounted to one of the vertical side members of the rear support frame. A second side support frame is pivotally connected to the other of the vertical side members of the rear support frame. At least one shelf is pivotally mounted to the rear support frame for movement between a horizontal position supported upon the first and second side support frames, and a vertical position removed from the first and second side support frames. One of the first and second side support frames is pivoted between a first position extending forwardly from the rear support frame, and a second position folded parallel to the rear support frame and forwardly of the at least one shelf in its vertical position. The other of the first and second side support frames is pivoted between a first position extending forwardly from the rear support frame, and a second position folded parallel to the rear support frame and forwardly of the one of the first and second support frames in its second position.

In another example, a shelving unit is movable between a shelf-supporting condition and a collapsed condition. The shelving unit includes a rear support frame having a pair of vertical side members, and a set of horizontal members extending between the vertical side members. A first side support frame has a front vertical member and a number of horizontal members pivotally connected to one of the vertical side members of the rear support frame by a first pivotal connection defined by a series of support brackets and including first legs having first ends fixed to one of the vertical side members and second ends attached by pivot pins to the horizontal members of the first side support frame. A second side support frame has a front vertical member and a number of horizontal members pivotally connected to the other of the vertical side members of the rear support frame by a second pivotal connection arrangement defined by a series of support brackets including second legs having first ends fixed to the other of the vertical side members and second ends attached by pivot pins to the horizontal side members of the second side support frame, the second legs being longer in length than a length of the first legs. At least one shelf is pivotably mounted to the rear support frame for movement between a horizontal position supported upon the first and second side support frames, and a vertical position removed from the first and second side support frames. One of the first and second side support frames is folded parallel to the rear support frame, and forwardly of the at least one shelf in its vertical position. The other of the first and second side support frames is folded parallel to and forwardly of the folded one of the first and second side support frames as a result of the length of the second legs being longer than the length of the first legs.

In a further example, a shelving unit includes a rear support frame having a pair of vertical side members, and a set of horizontal members extending between the vertical side members. A first side support frame is pivotally connected to one of the vertical side members of the rear support frame, and is provided with a first shelf-supporting structure. A second side support frame is pivotally connected to the other of the vertical side members of the rear support frame, and is provided with a second shelf-supporting structure. A first shelf is pivotally mounted between the vertical side members for movement between a horizontal position supported on the first and second shelf-supporting structure, and a vertical position removed from the first and second shelf-supporting structure and received between the vertical side members. A second shelf is pivotally mounted between the vertical side members for movement between a horizontal position supported on the first and second shelf-supporting structure above the first shelf in its horizontal position, and a vertical position removed from the first and second shelf-supporting structure, and received between the vertical side members. A third shelf is pivotally connected between the vertical side members for movement between a horizontal position supported on the first and second shelf-supporting structure above the second shelf in its horizontal position, and a vertical position removed from the first and second side-supporting structure, and positioned forwardly of and against the second shelf in its vertical position. One of the first and second side support frames is pivoted between a first position extending forwardly from the rear support frame, and a second position folded parallel to the rear support frame and lying forwardly and against the third shelf in its horizontal position. The other of the first and second side support frames is pivoted between a first position extending forwardly from the rear support frame, and a second position folded parallel to the rear support frame and forwardly of the one of the first and second side support frames in its second position. The shelving unit is converted between a shelf-supporting condition and a collapsed storage condition in which the rear support frame, the third shelf, and the first and second side support frames form a compact, folded, layered, parallel arrangement with one another.

Various other features, objects and advantages of the invention will be made apparent from the following description taken together with the drawings.

BRIEF DESCRIPTION OF THE DRAWINGS

The drawings illustrate the best mode presently contemplated of carrying out the invention.

In the drawings.

DETAILED DESCRIPTION

Figure 2:
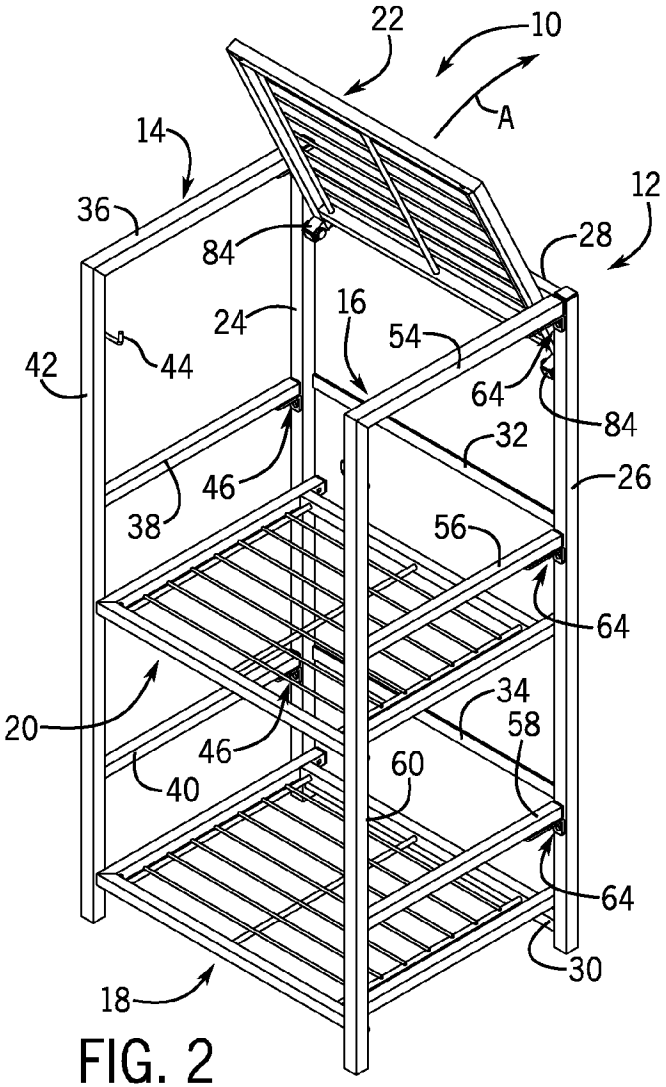
FIGS. 2-9 are sequential front perspective views showing various stages of the shelving unit of FIG. 1 being folded towards a collapsed storage condition.

A one piece, preassembled collapsible shelving unit 10 of the present disclosure is variously illustrated in FIGS. 1-12. An exemplary embodiment of the shelving unit 10 is generally comprised of a rear support frame 12, a movably mounted left side support frame 14, a movably mounted right side support frame 16, and a plurality of movably mounted shelves including a bottom shelf 18, a middle shelf 20, and a top shelf 22.

In the example illustrated, the shelving unit 12 is provided with three shelves, but it should be understood that the shelving unit 10 can be constructed with at least one or two shelves and may have more than three shelves in an alternate configuration contemplated by the present disclosure. As seen in the drawings, the shelving unit 10 is variously configurable between a shelf-supporting condition (FIG. 1) used to support and hold a variety of items, and a collapsed condition (FIGS. 9, 10) which allows for convenient transport and stowage of the shelving unit 10.

As seen in the drawings, the rear support frame 12 has a pair of opposing vertical side members 24, 26, respectively, and a series of four horizontal cross members including upper and lower horizontal cross members 28, 30 respectively, and intermediate horizontal cross members 32, 34 extending between the vertical side members 26, 28 to provide a rigid rear support structure.

The left side support frame 14 has an upper horizontal member 36, an intermediate horizontal member 38, and a lower horizontal member 40, each of which has a forward end fixed to a vertical front member 42. A rear face of the vertical front member 42 provides a mounting surface to which three spaced apart inwardly and upwardly extending shelf-supporting hooks 44 (FIG. 4) are fixed. Rearward ends of the upper, intermediate and lower horizontal members 36, 38, 40 respectively, are each pivotally mounted to the vertical member 24 of the rear support frame 12 by a first pivotal connection 46.

Figure 11:
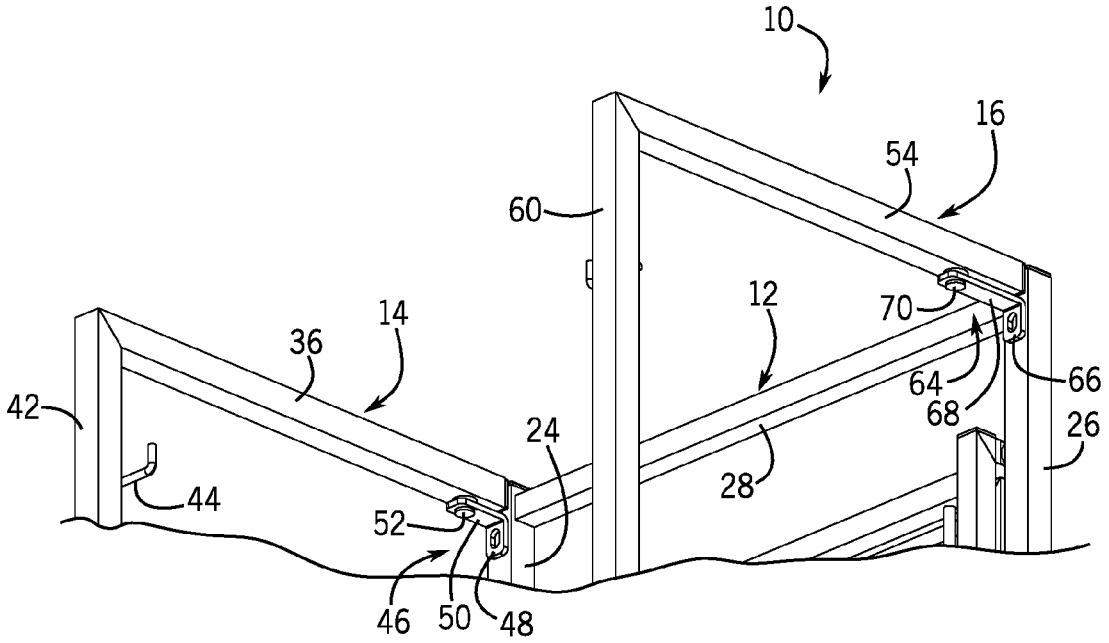
FIG. 11 is an enlarged fragmentary front perspective view of an upper end of the shelving unit in a partially collapsed storage position.
Figure 12:
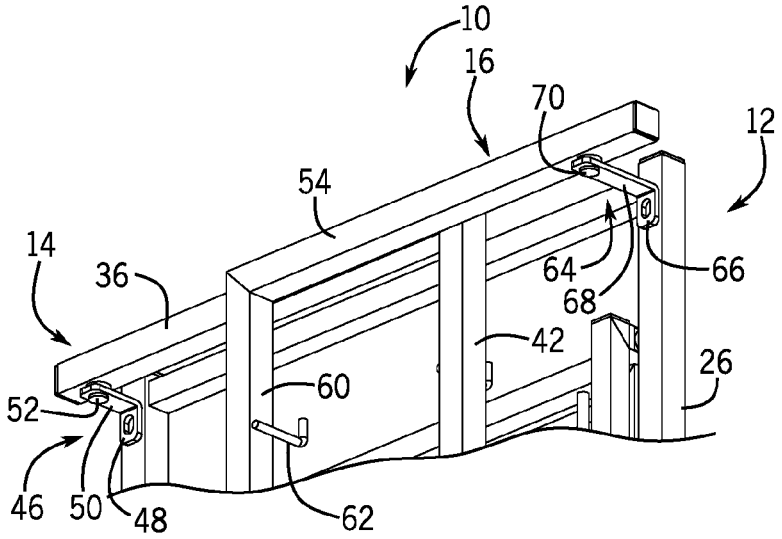
FIG. 12 is a view similar to FIG. 11 showing the shelving unit in a fully collapsed storage condition

As best seen in FIGS. 11 and 12, each of the pivotal connections 46 is defined by a rigid L-shaped support bracket having a vertical leg 48 integrally joined to a forwardly extending horizontal leg 50. Each vertical leg 48 is fixed to a front surface of the vertical side member 24 beneath each of the horizontal members 36, 38, 40. Each horizontal leg 50 has an outer end which is attached by a pivot pin 52 to an underside of the horizontal members 36, 38, 40 at a location spaced slightly forwardly from a rearmost end of each of the horizontal members 36, 38, 40. The pivotal connections 46 enable the left side support frame 14 to be pivotally mounted about a vertical pivot axis to the vertical side member 24 of the rear support frame 12.

The right side support frame 16 has an upper horizontal member 54, an intermediate horizontal member 56, and a lower horizontal member 58, each of which has a forward end fixed to a vertical front member 60. A rear face of the vertical front member 60 serves as a mounting surface to which three spaced apart, inwardly and upwardly extending shelf-supporting hooks 62 (FIG. 6) are fixed. Rearward ends of the upper, intermediate and lower horizontal members 54, 56, 58 respectively, are each pivotally mounted to the vertical side member 26 by a second pivotal connection 64.

With further reference to FIGS. 11 and 12, each of the three pivotal connections 64 is defined by a rigid L-shaped support bracket having a vertical leg 66 integrally joined to a forwardly extending horizontal leg 68. Each vertical leg 66 is fixed to a front surface of the vertical member 26 beneath each of the horizontal members 54, 56, 58. Each horizontal leg 68 has an outer end which is attached by a pivot pin 70 to an underside of the horizontal members 54, 56, 58 at a location spaced slightly forwardly from a rearmost end of each of the horizontal members 54, 56, 58. The pivotal connections 64 enable the right side support frame 16 to be pivotally mounted about a vertical pivot axis to the vertical side member 26.

As a unique feature of the present disclosure, the length of each of the horizontal legs 68 of the pivot connections 64 is longer than the length of each of the horizontal legs 50 of the pivot connections 46. The length differences of the horizontal legs 50, 68 permit the left side support frame 14 and the right side support frame 16 to be pivoted towards each other to a preferred compact overlapping parallel arrangement which results when the shelving unit 10 is folded to the collapsed condition as will be described hereafter.

Figure 1:
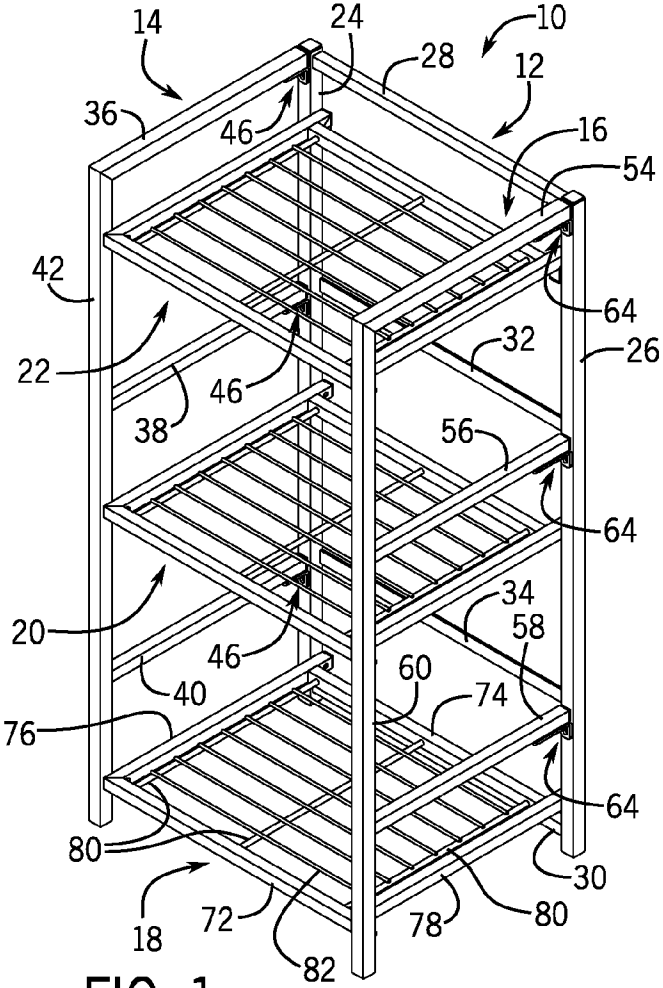
FIG. 1 is a front perspective view of a one piece collapsible shelving unit in accordance with the present disclosure and shown in an unfolded shelf-supporting condition.
Figure 4:
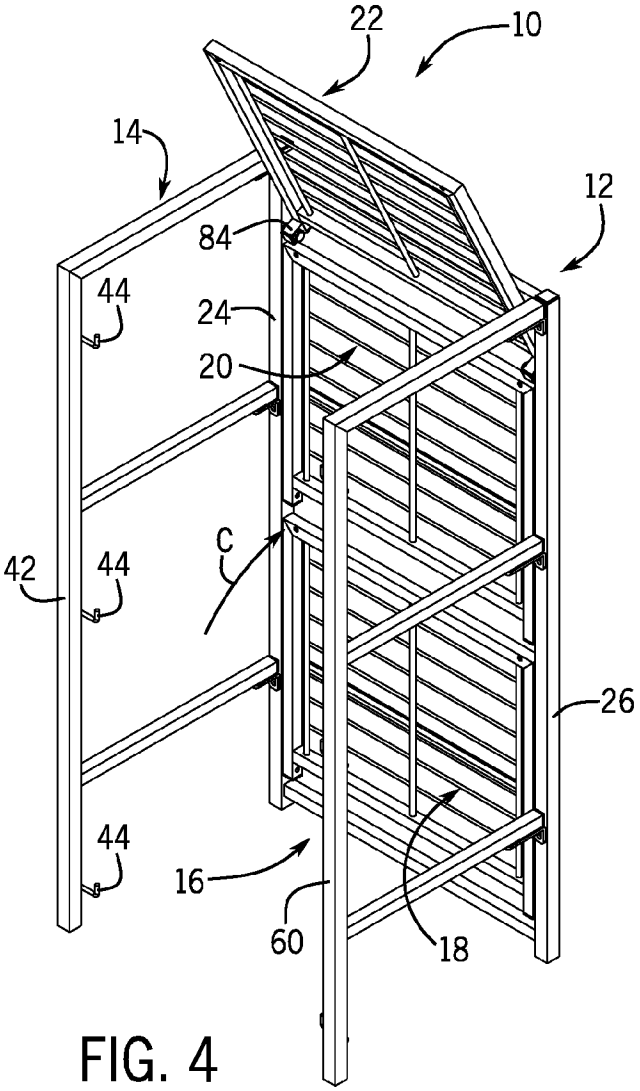
Figure 6:
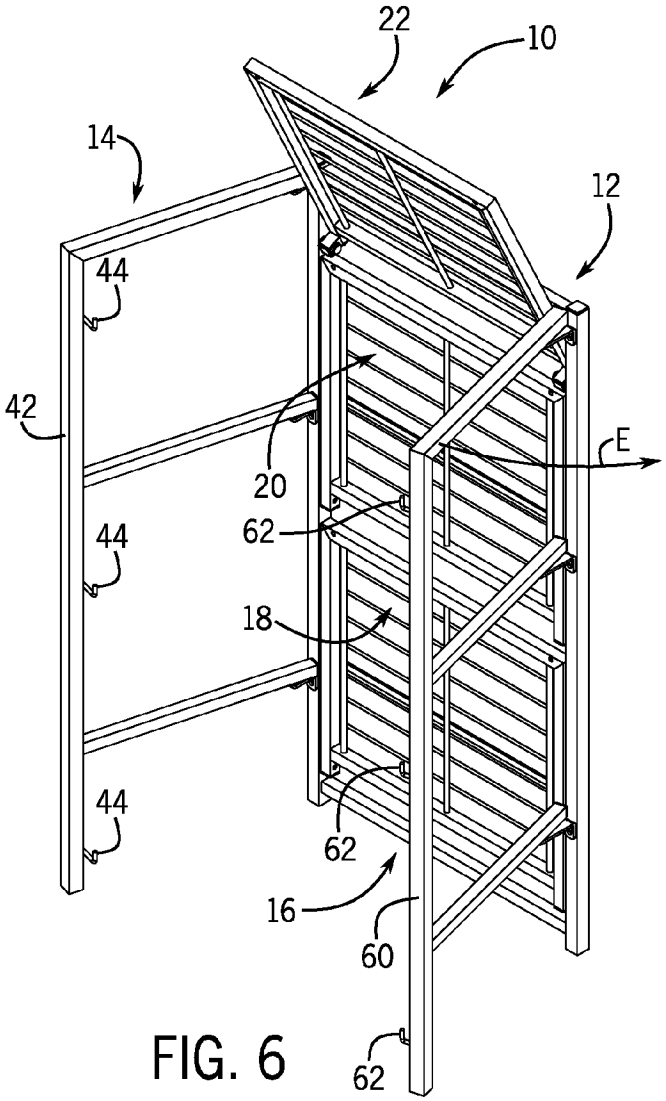
Figure 5:
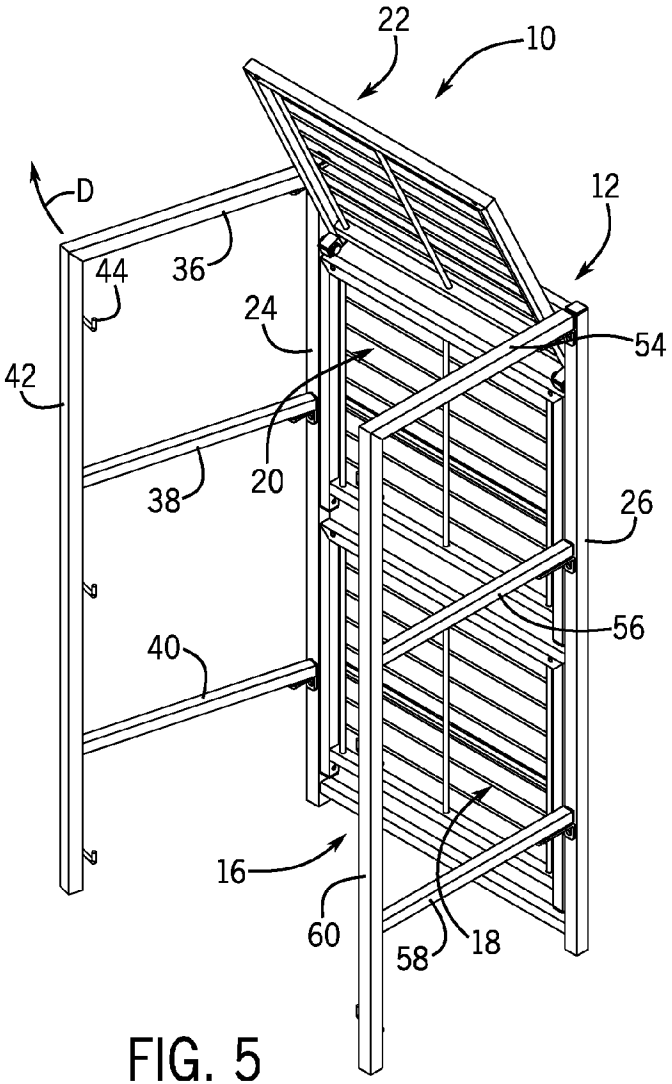

As seen in FIG. 1, each of the shelves 18, 20, 22 has an identical construction, and includes a front rail 72, a rear rail 74 and opposed side rails 76, 78 which together form a rectangular shelf frame. Wire rods 80 extend between the front rail 72 and the rear rail 74, and wire members 82 extend transversely across and are connected to the wire members 82 to form a support surface. Rearward outer corners of the shelves 18, 20, 22 are pivotally mounted by a pair of pivotal connections 84, such as provided on the opposed sides of shelf 22 in FIG. 2, to inside surfaces of the vertical side members 24, 26 to enable each of the shelves 18, 20, 22 to swing about a separate horizontal pivot axis. Each of the shelves 18, 20 is configured to pivot between a horizontal position (FIGS. 1-3) and a vertical raised position (FIGS. 4-6). The shelf 22 is configured to pivot between a horizontal position (FIG. 1) and a vertical lowered position (FIGS. 7-10). In the horizontal position shown in FIG. 1, the side frames 76, 78 of the shelves 18, 20, 22 are supported by the hooks 44, 62 provided on opposite front members 42, 60 respectively. In the vertical raised position, the shelves 18, 20 are sized to be completely received between the vertical side members 24, 26, and are prevented from travel rearwardly of the rear support frame 12 by the cross members 32, 34 thereof. In the vertical, lowered position, the shelf 22 is positioned forwardly of and engaged against the raised shelf 20 in parallel relation therewith. The pivotal connections 84 provided on the shelves 18, 20, 22 are configured with a frictional resistance so that each shelf 18, 20, 22 when pivoted will not freefall by gravity when being pivotally moved.

FIG. 1 illustrates the shelving unit 10 in a shelf supporting condition ready to hold items such that the shelves 18, 20, 22 in their horizontal positions are supported by the hooks 44, 62. The left side support frame 14 and the right side support frame 16 extend forwardly in substantially parallel relationship from the rear support frame 12 with the upper cross member 28 and the upper horizontal members 36, 54 being elevated above the top shelf 22. Engagement of the hooks 44, 62 with the shelves 18, 20, 22 prevents any pivotal movement of the left and right side support frames 14, 16. The upper horizontal members 36, 54 define handles which may be grasped by a user if it is desired to move the shelving unit 10 while in the shelf-supporting condition. Although not illustrated in the exemplary embodiment, the bottom ends of the vertical members 24, 26, 42, 60 may be equipped with adjustable feet.

Figure 3:
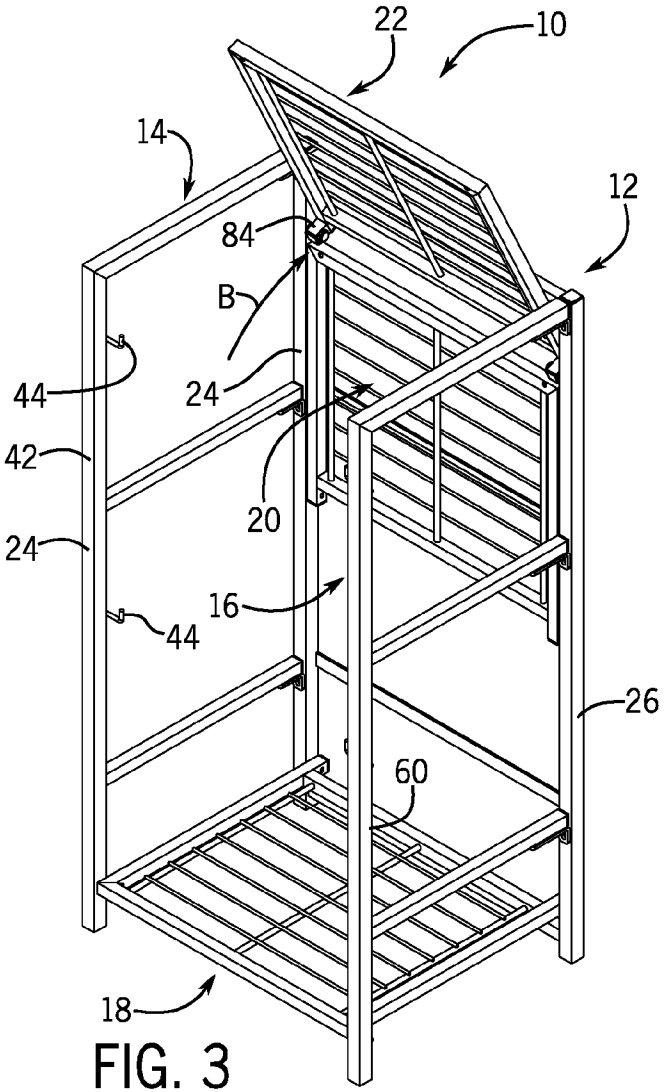
Figure 8:
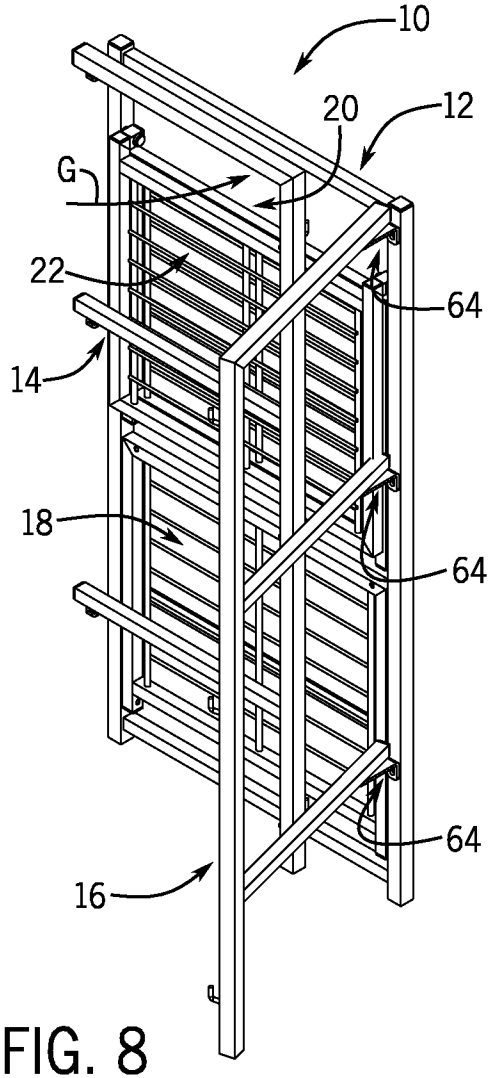
Figure 7:
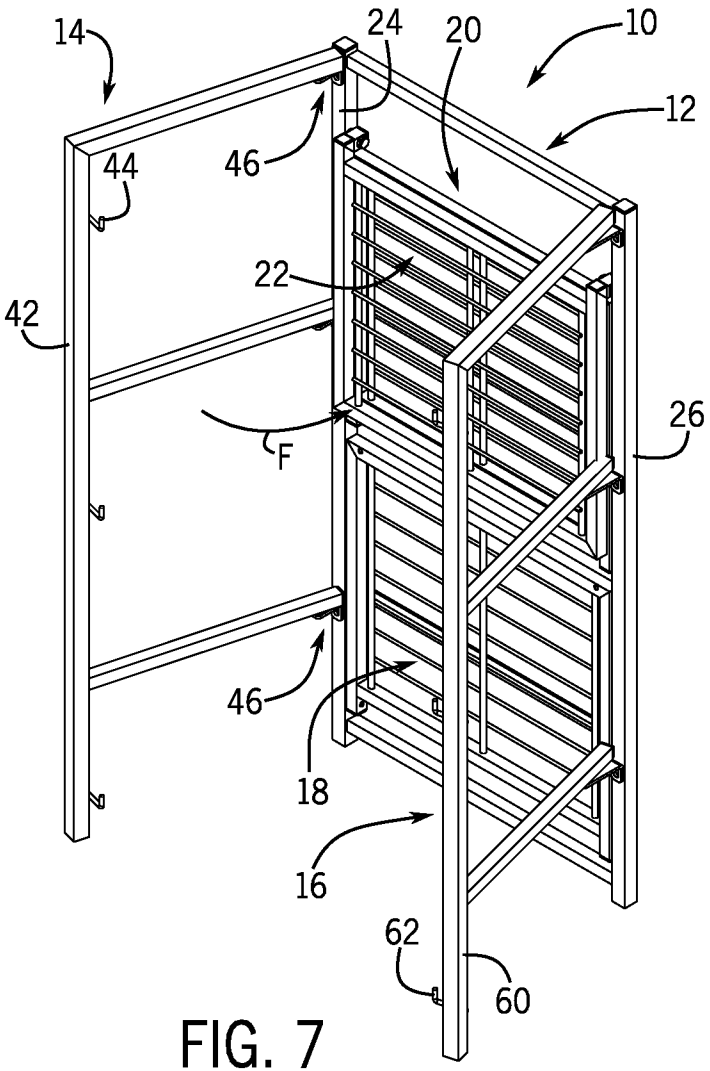
Figure 9:
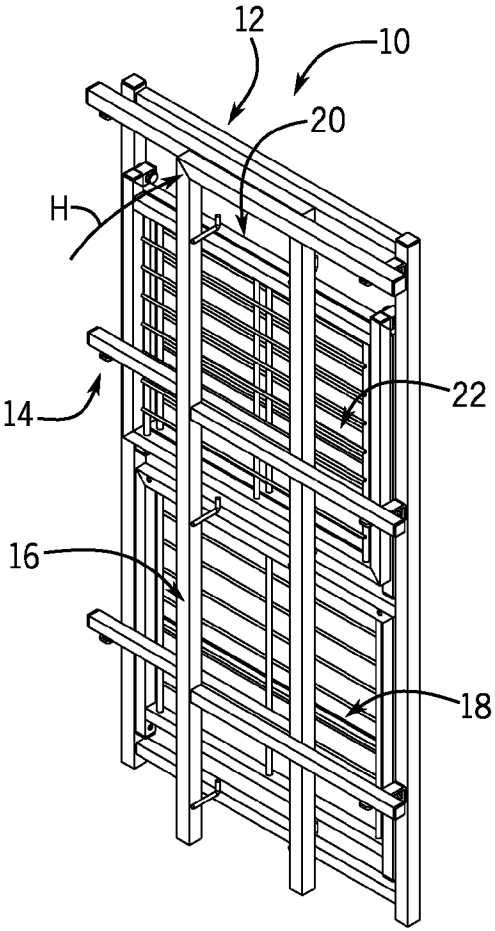

When it is desired to convert the shelving unit 10 shown in FIG. 1 from a shelf-supporting condition to a collapsed condition, the top shelf 22 is pivoted upwardly to a raised position in the direction of arrow A as shown in FIG. 2. Then, the middle shelf 20 is pivoted upwardly in the direction of arrow B to the vertical raised position and received completely between the vertical side members 24, 26 as shown in FIG. 3. The bottom shelf 18 is also pivoted upwardly to the vertical raised position in the direction of arrow C and received completely between the vertical side members 24, 26 in alignment with and below the raised middle shelf 20 as shown in FIG. 4. Next, the left side support frame 14 is pivoted outwardly in the direction of arrow D as shown in FIG. 5 followed by the right side support frame 16 being pivoted outwardly in the direction of arrow E as shown in FIG. 6. Pivoting of the left side and right side support frames 14, 16 so that they are in a diverging relationship moves the hooks 44, 62 outwardly to provide an obstruction free path through which the top shelf 22 is moved during downward pivoting thereof in the direction of arrow F to the lowered vertical position parallel and lying forwardly of and against the raised middle shelf 20 as shown in FIG. 7. At this point, the left side support frame 14 is pivoted inwardly in the direction of arrow G as shown in FIG. 8 so that it is parallel to the rear support frame 12 and lies against and forwardly of the lowered top shelf 22. Finally, the right side support frame 16 is pivoted inwardly in the direction of arrow H as shown in FIG. 9 so that it is also parallel to the rear support frame 12 and lies against and forwardly of the folded left side support frame 14 to attain the collapsed position of the shelving unit 10.

Figure 10:
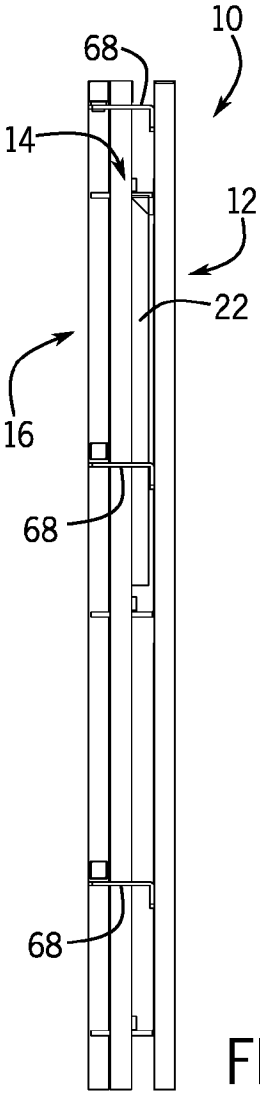
FIG. 10 is a right side view of the shelving unit in the collapsed storage condition shown in FIG. 9.

As seen in FIG. 10, the shelving unit 10 in the collapsed condition provides a compact, folded, layered parallel arrangement of the rear support frame 12, the top shelf 22, the left side support frame 14 and the right side support frame 16 which is conducive to easy transport and storage. The collapsed layered arrangement of the shelving unit 10 is made possible by sizing the shelves 18, 20 to fit completely between the vertical side members 24, 26, by placing the shelf 22 in parallel with and flush against the shelf 20 and by particularly configuring the horizontal legs 68 of the pivot connections 64 to be longer than the lengths of the horizontal legs 50 of the pivot connections 46 so that the right side support frame 16 lies flush against the left side support frame 14 and the left and right side frame members 14, 16 are parallel to the rear support frame 12. The present disclosure contemplates that the left side support frame 14 could be folded upon the right side support frame 16 by making the lengths of the legs 50 on the pivot connections 46 longer than the lengths of the legs 68 of the pivot connections 64. It should also be appreciated that the shelving unit 10 can be quickly and conveniently set up in the shelf-supporting condition with several simple unfolding steps and without the need for any tools and fasteners.

In the present disclosure, certain terms have been used for brevity, clearness and understanding. No unnecessary limitations are to be implied therefrom beyond the requirement of the prior art because such terms are used for descriptive purposes only and are intended to be broadly construed. The different configurations, systems and method steps described herein may be used alone or in combination with other configurations, systems and method steps. It is to be expected that various equivalents, alternatives and modifications are possible within the scope of the appended claims.

What is claimed is:

1. A shelving unit movable between a shelf-supporting condition and a collapsed condition comprising:

a rear support frame having a pair of vertical side members, and a set of horizontal members extending between the vertical side members;

a first side support frame pivotally connected to one of the vertical side members of the rear support frame;

a second side support frame pivotally connected to the other of the vertical side members of the rear support frame;

a shelf arrangement being pivotally mounted to the rear support frame for movement between a horizontal position supported upon the first and second side support frames, and a vertical position removed from the first and second side support frames, wherein the shelf arrangement includes a bottom shelf which in a vertical position thereof is completely received between the vertical side members of the rear support frame, a middle shelf which in a vertical position thereof is completely received between the vertical side members of the rear support frame and positioned above the bottom shelf in the vertical position thereof, and a top shelf which in a vertical position thereof is positioned forwardly of and parallel to the middle shelf in the vertical position thereof, and parallel to the rear support frame;

one of the first and second side support frames being pivoted between a first position extending forwardly from the rear support frame, and a second position folded parallel to the rear support frame, parallel to the bottom shelf and the middle shelf in the vertical positions thereof and lying forwardly of and against the top shelf in the vertical position thereof, and the other of the first and second side support frames being pivoted between a first position extending forwardly from the rear support frame, and a second position folded parallel to the rear support frame, and forwardly of the folded one of the first and second side support frames in the second position thereof, and wherein rear corners of the shelf arrangement are pivotally connected to the vertical side members of the rear support frame by a shelf pivotal connection arrangement configured with frictional resistance to prevent freefall of the shelf arrangement and to continuously maintain the position of the shelf arrangement during pivotal movement thereof between the horizontal position and the vertical position of the shelf arrangement.

2. A shelving unit movable between a shelf-supporting condition and a collapsed condition comprising:

a rear support frame having a pair of vertical side members, and a set of horizontal members extending between the vertical side members;

a first side support frame having a front vertical member and a number of horizontal members pivotally connected to one of the vertical side members of the rear support frame by a first pivotal connection arrangement defined by a series of support brackets including first legs having first ends fixed to the one of the vertical side members, and second ends attached by pivot pins to the horizontal members of the first side support frame;

a second side support frame having a front vertical member and a number of horizontal members pivotally connected to the other of the vertical side members of the rear support frame by a second pivotal connection arrangement defined by a series of support brackets including second legs having first ends fixed to the other of the vertical side members, and second ends attached by pivot pins to the horizontal members of the second side support frame, the second legs being longer in length than a length of the first legs;

at least one lower shelf being pivotally mounted to the rear support frame for movement between a horizontal position supported upon the first and second side support frames, and a vertical position removed from the first and second side support frames and folded against one of the horizontal members of the rear support frame such that the at least one lower shelf is completely received between the vertical side members of the rear support frame;

an upper shelf being pivotally mounted to the rear support frame for movement between a horizontal position supported on the first and second side support frames, and a vertical position removed from the first and second side support frames and folded forward against the at least one lower shelf in the vertical position thereof so that the upper shelf is parallel to both the rear support frame and the at least one lower shelf;

one of the first and second side support frames being folded parallel to the rear support frame and forwardly of the upper shelf in the vertical position thereof; and the other of the first and second side support frames being folded parallel to and forwardly of the folded one of the first and second side support frames as a result of the length of the second legs being longer than the length of the first legs such that the rear support frame, the upper shelf, and the first and second side support frames sequentially form a compact folded, layered, parallel arrangement with one another.

3. The shelving unit of claim 2, wherein the pivot pins of the first and second pivotal connection arrangements are positioned at locations spaced forwardly from rearmost ends of the horizontal members of the first and second side support frames.

4. A shelving unit comprising:

a rear support frame having a pair of vertical side members, and a set of horizontal members extending between the vertical side members;

a first side support frame pivotally connected to one of the vertical side members of the rear support frame, and provided with a first shelf-supporting structure;

a second side support frame pivotally connected to the other of the vertical side members of the rear support frame, and provided with a second shelf-supporting structure;

a first shelf pivotally mounted between the vertical side members for movement between a horizontal position supported on the first and second shelf-supporting structure, and a vertical position removed from the first and second shelf-supporting structure and completely received between the vertical side members;

a second shelf pivotally mounted between the vertical side members for movement between a horizontal position supported on the first and second shelf-supporting structure above the first shelf in the horizontal position thereof, and a vertical position removed from the first and second shelf-supporting structure, and completely received between the vertical side members;

a third shelf pivotally connected between the vertical side members for movement between a horizontal position supported on the first and second shelf-supporting structure above the second shelf in the horizontal position thereof, and a vertical position removed from the first and second shelf-supporting structure, and positioned forwardly of and against the second shelf in the vertical position thereof;

one of the first and second side support frames being pivoted between a first position extending forwardly from the rear support frame, and a second position folded parallel to the rear support frame, parallel to the first shelf and the second shelf in the vertical positions thereof and lying forwardly of and against the third shelf in the vertical position thereof; and the other of the first and second side support frames being pivoted between a first position extending forwardly from the rear support frame, and a second position folded parallel to the rear support frame and lying forwardly of the one of the first and second side support frames in the second position thereof, wherein the shelving unit is converted from a shelf-supporting condition to a collapsed storage condition in which the rear support frame, the third shelf, and the first and second side support frames sequentially form a compact folded, layered, parallel arrangement with one another.

5. The shelving unit of claim 4, wherein the first shelf and the second shelf in the vertical positions thereof are prevented from travel behind the rear support frame by the horizontal members thereof.

* * * * *